United States Patent [19]

Schultheis

[11] 4,190,795

[45] Feb. 26, 1980

Best Available Copy

[54] CONSTANT INTENSITY LIGHT SOURCE

[75] Inventor: Stephen M. Schultheis, West Covina, Calif.

[73] Assignee: Coberly & Associates, Pasadena, Calif.

[21] Appl. No.: 831,904

[22] Filed: Sep. 9, 1977

[51] Int. Cl.[2] ..... G05F 1/56

[52] U.S. Cl. ..... 323/17; 315/158; 323/21

[58] Field of Search ..... 315/151, 158, DIG. 5, 315/DIG. 7; 323/21, 17, DIG. 1; 340/600, 641, 653, 661

[56] References Cited

U.S. PATENT DOCUMENTS

| | | | |
|---|---|---|---|
| 3,483,428 | 12/1969 | La Plante | 323/21 X |
| 3,599,037 | 8/1971 | Grace | 323/21 UX |
| 3,675,074 | 7/1972 | Dennewitz | 323/21 X |
| 3,700,960 | 10/1972 | Lake | 323/21 X |
| 3,718,821 | 2/1973 | Vischulis | 323/21 UX |
| 3,890,537 | 6/1975 | Park et al. | 323/DIG. 1 |
| 3,927,571 | 12/1975 | Athey | 340/661 X |
| 3,976,910 | 8/1976 | Owens | 315/DIG. 5 |
| 3,996,494 | 12/1976 | Suga | 315/158 X |

*Primary Examiner*—A. D. Pellinen

*Attorney, Agent, or Firm*—Wills, Green & Mueth

[57] ABSTRACT

A power apparatus to maintain a lamp at constant intensity by varying power to the lamp in response to changes in the voltage across a light sensing element. That voltage is automatically compared to a preset reference voltage and the output to the lamp is varied such that any difference in those voltages is eliminated.

3 Claims, 4 Drawing Figures

CONSTANT INTENSITY LIGHT SOURCE

BACKGROUND OF THE INVENTION

A photolithographic process is generally used in the fabrication of semiconductor devices. In this process, a thin film of chemical photoresist is applied to the surface of a very thin crystalline material. A pattern on that surface is then exposed to ultraviolet light under controlled conditions. The exposed photoresist undergoes a chemical change which causes it to be either removed or retained when the crystalline material is later given a chemical bath. The pattern therefore defines an area on the crystalline material surface to be subjected to or protected from subsequent processing steps.

Demands are constantly being made for increased miniaturization of circuit design, with some structures presently required in the sub-micron line width region. The control of all process variables is therefore critical.

The principal variables in the photolithographic process are (1) the photoresist film thickness, (2) the exposure speed of the chemical photoresist, (3) the ultraviolet light intensity, uniformity and collimation during exposure, and (4) the exposure time. Photoresist film thickness is not difficult to control by viscosity and mechanical means, and stable photoresists are available with exposure speeds within a known and repeatable specification. Electromechanical timers of high accuracy are also available to control shutters to a predetermined exposure time. This invention involves the control of light intensity during exposure.

The control of light intensity from a high pressure mercury vapor lamp of the type used in this process cannot be accomplished by simply providing the lamp with a constant level of power. The intensity of those lamps decreases over time as the lamp interior becomes discolored from mercury and electrode material deposited thereon.

One approach to this problem has been to integrate the light intensity over time to arrive at an exposure time which will allow the desired amount of light to contact the photoresist. The exposure time is therefore increased as material deposited on the inside of the lamp envelope decreases light intensity. This longer time period results in unnecessary undercutting of the desired pattern due to chemical cross-linking of the photoresist molecules.

Another approach has been to attempt to maintain the light intensity constant by increasing the power to the lamp as the deposit of foreign matter takes place. The devices heretofore produced have utilized photodiodes as light sensors. Because a photodiode varies current in relation to lamp intensity, it is inherently ill-suited for this purpose. The light intensity range to which it can respond is limited by the current which it can safely carry. In fact, the photodiodes used can only sense light to a maximum intensity in the neighborhood of 2 or 4 mw/cm$^2$. It is for this reason that existing constant intensity light sources have light sensors placed behind mirrors specially coated to permit passage of only a portion of the lamp light. These mirrors not only lose some of the lamp energy, but are a source of considerable expense and error. The special coating is costly to apply and often has low spots of reflectivity not experienced in conventional silvered mirrors. The low spots are particularly noticeable in research and work involving extreme miniaturization.

Photodiodes used for this purpose are also larger than is desirable. Their size has a lower limit imposed by the requirement that they be able to take a relatively high maximum current. This would interfere with placement directly in the light path even if their intensity-sensing range were great enough.

Constant intensity light sources in this field have also caused damage to other sensitive electronic equipment. Highly sophisticated equipment such as mask aligners must be located adjacent to or be a part of the light source, yet existing equipment can send damaging spikes through the supply lines or electromagnetic fields through space toward that equipment.

Existing mercury arc lamp power supplies in this field also have not provided a minimum power mode to operate the lamp during long periods between exposures. The lamps are therefore operated continuously at high power levels, causing foreign matter to be deposited on the inside of the glass envelope at a needlessly high rate.

SUMMARY OF THE INVENTION

This invention relates to a power supply for driving a mercury arc lamp at constant light intensity through the use of a phototransistor sensor which varies an applied voltage in relation to the intensity of light from the lamp. That voltage then controls the power out to the lamp to maintain the light intensity at a constant value. This is done through an interface circuit which automatically compares the sensor voltage to a preset reference voltage and varies the power out to the lamp to eliminate any difference.

Because the voltage is varied, the device has a much greater light intensity range than a photodiode. It is able to sense light intensities throughout the range 0–50 mw/cm$^2$. That easily concompasses the intensities used in the manufacture of semiconductor devices. The sensor can therefore be placed directly in the light path, and the problem of special coated mirrors is avoided.

The device can also be made considerably smaller, despite its wider range. This is because it operates on a relatively small current, with only the voltage varying. The sensor can therefore be placed in the region of the work to be exposed without unduly limiting the work area.

The invention further relates to internal calibration means in a constant intensity light source which allows quick recalibrations when a lamp element is replaced or when one or more lens or mirror settings are varied. While the lamp is provided with power at a predetermined level, the reference voltage can be manually adjusted to just equal the voltage across the light sensor. An LED is caused to ignite at that point.

The invention still further relates to an igniter for a mercury arc lamp used for photolithography which includes a high voltage source adapted to apply a series of similar high voltage pulses to the lamp until it is ignited. Ignition results in a drop in a steady driving voltage applied across the lamp electrodes, which voltage drop is sensed by the igniter. The igniter is automatically disabled while other sensitive electronic equipment is in operation.

This invention still further relates to a constant light intensity power source for mercury arc lamps which incorporates two stages of transformer isolation to eliminate problems of line voltage interference and damage to sensitive electronic equipment in the area.

This invention still further relates to a constant light intensity power source for mercury arc lamps which is adapted to provide those lamps with a minimum operating power level during long periods between uses.

It is an object of the present invention to provide an improved constant intensity light source.

It is also an object of the invention to provide a constant intensity light source for use in photolithographic processes for the manufacture of semiconductor devices.

It is a further object of the invention to provide a constant intensity light source which utilizes a voltage varying device as a light sensor.

It is a still further object of the invention to provide a constant intensity light source having a light sensor which can be placed directly in the path of light.

It is a still further object of the invention to provide a constant intensity light source whose sensor can operate in a wide range of light intensity.

It is a still further object of the invention to provide a constant intensity light source which will not interfere with or damage sensitive electronic equipment in the area or connected to the same power circuit.

The instant invention may be constructed as three functional modules for the operation of a high pressure mercury arc lamp to produce light of a constant intensity. Those modules are a constant power supply with a variable output, a constant light intensity interface utilizing optical sensing feedback, and a lamp igniter.

It is to be understood that all currents referred to herein are hole currents, rather than electron currents, in keeping with the convention regarding currents in semiconductor devices.

Figure 1:
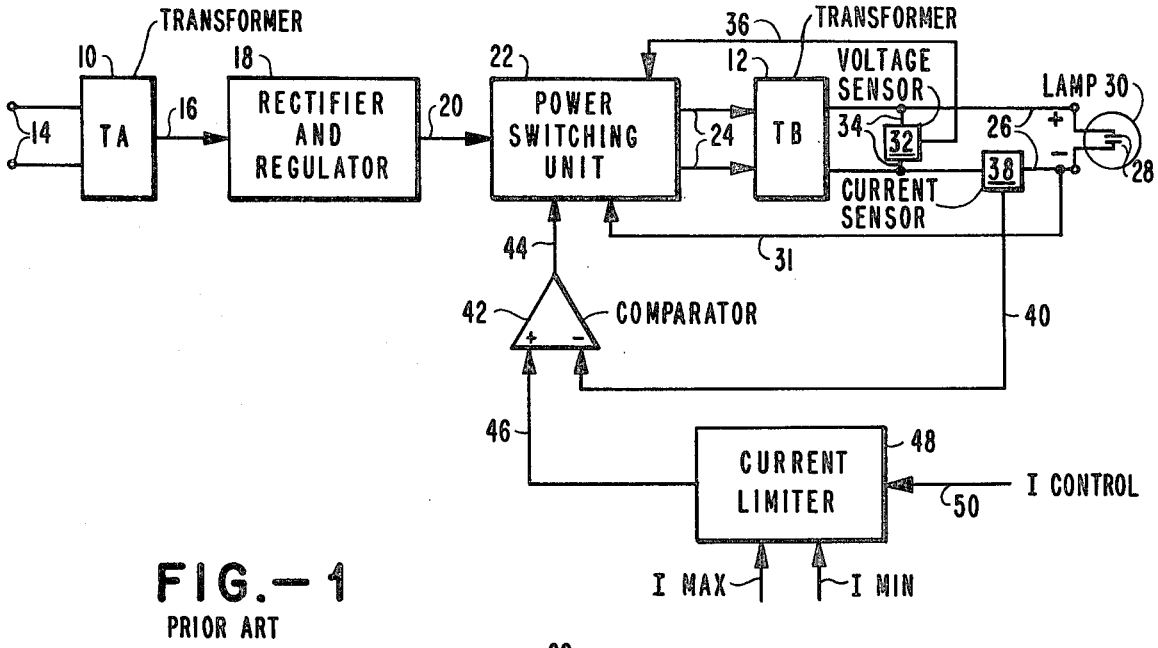
FIG.—1 PRIOR ART
FIG. 1 is a block diagram of a constant power supply with variable output which is constructed in accordance with the invention.

FIG. 1 shows a constant power supply with a variable output. It has two stages of transformer isolation, 10 and 12. Transformer 10 is connected to line voltage through primary leads 14. Secondary leads 16 of transformer 10 are connected to rectifier and regulator 18 whose outputs 20 are connected to the supply input terminals of power switching circuit 22. Switching unit 22 is a conventional complementary switching regulator adapted to provide power to the primary coil of transformer 12. The secondary leads 26 of transformer 12 are connected to the respective electrodes 28 of lamp 30. A bus 31 is wired between the power switching unit and the negative terminal of the lamp. Voltage sensor 32 has its inputs 34 connected in parallel across leads 26 and supplies feedback to power switching unit 22 by way of output lead 36. Current sensor 38 has its input leads connected into the negative one of leads 26. The output lead 40 of sensor 38 provides one of the inputs to current comparator 42, whose output is in turn connected to a power control input of power switching unit 22 via line 44. The second input to current comparator 42 is provided by line 46 from current limiter 48. The current limiter receives a control current ($I_{control}$) from the constant intensity network of FIG. 2 through its input line 50. Current limiter 48 is a conventional device which allows any current between its maximum and minimum limits to pass in inverted form, but will never put out a current outside those limits. It thus serves to prevent damage to the mercury lamp 30 which has maximum and minimum safe operating powers.

The power supply as thus constructed is a commercially available at this time as Power Supply EMHG 200 manufactured by Electronic Measurements, Inc., of Neptune, N.J., however it is designed for uses different from those disclosed herein. The features important to its use in the instant device are the variation of output current by changes in an input current and the protection afforded to nearby equipment by two stages of transformer isolation between the lamp and the line voltage. Constant intensity light sources developed in the past have damaged sensitive equipment connected to the same line voltage source.

Transformer 10 and rectifier regulator 18 provide an isolated and regulated DC voltage to the power switching unit 22. The DC output of switching unit 22 is further isolated by transformer 12 before it is applied across lamp electrodes 28 through wires 26. Lamp current and voltage are constantly monitored by the power switching unit 22 through sensors 32 and 38. Current alone is changed to vary the power. Voltage remains constant due to lamp construction.

The current along the lead 46 to the comparator 42 is always positive and greater than the positive current along the lead 40, producing a positive comparator output voltage at line 44 which increases as the current along the lead 46 increases and decreases as the current along the lead 40 increases. The power switching unit 22 increases and decreases the power to the bulb proportionally with the output voltage from the comparator 42.

The feedback circuit comprising the current sensor 38, and the comparator 42 thus serves to minimize line fluctuations and noise in the DC output power to the lamp 30. For example, an increase in the current to the lamp caused by line voltage fluctuation will increase the current along the line 40 and cause the voltage at the line 44 to decrease. This lowers the output of the power switching unit 22 a proportional amount, causing the output current to return to the level held prior to the fluctuation.

The current $I_{control}$ carried by the line 50 determines the output current to the lamp ($I_{out}$) according to the formula $I_{out}=K/I_{control}$, where $I_{control}$ has a value between the maximum and minimum limits of the current limiter 48. This is true because the current carried by the line 46 is then the inverse of $I_{control}$, and $I_{out}$ increases and decreases with the current along the line 46. Since the voltage across the lamp is maintained constant as a result of its construction, the power output to the lamp ($P_{out}$) is also inversely proportional to $I_{control}$.

Figure 2:
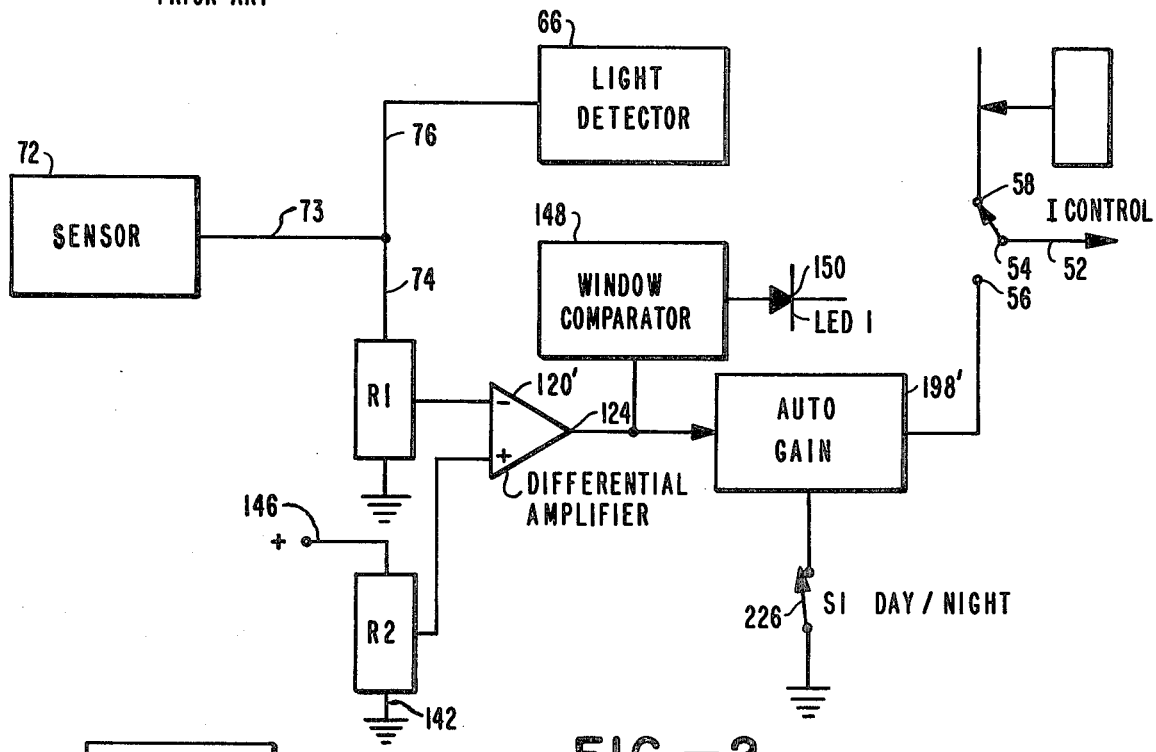
FIG. 2 is a somewhat simplified block diagram of a constant light intensity interface constructed in accordance with the invention.
Figure 4:
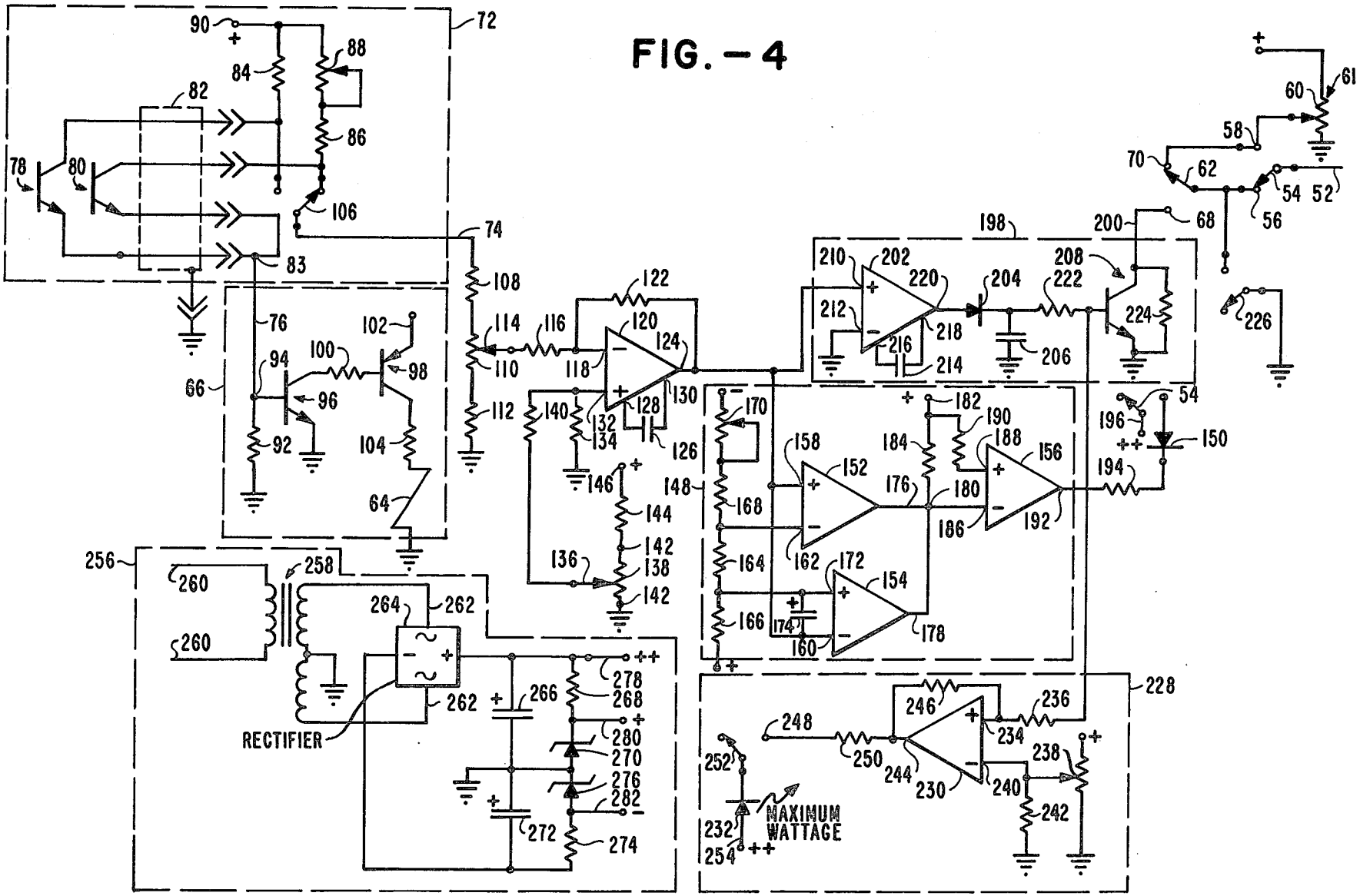
FIG. 4 is a schematic diagram of the constant light intensity interface of FIG. 2.

The constant light intensity network of FIGS. 2 and 4 is designed to produce a current ($I_{control}$) which will cause the power supply of FIG. 1 to drive lamp 30 at a constant intensity. Referring now to FIG. 4, $I_{control}$ is the output of the network along line 52. Switch 54 is a manual two-position switch adapted to complete the circuit between line 52 and either terminal 56 or 58 of the network. Terminal 56 leads to the constant light intensity circuitry discussed below, while terminal 58 leads to a potentiometer 61 having a fixed resistance 60 across which a constant voltage is applied. A predetermined constant current therefore flows along line 52 from terminal 58 whenever switch 54 is positioned to contact that terminal. That position defines a constant power mode because the current causes the power supply of FIG. 1 to supply a predetermined constant power to lamp 30. This predetermined constant power is adjusted through the potentiometer 61 to the level recommended by the lamp manufacturer to prolong lamp life and avoid overheating. The opposite position of switch 54 defines a constant light intensity mode which is useful in photolithography. Switch 62 is connected to terminal 56 and is automatically actuable by a relay element 64 of light detector 66, as will be discussed below. It is a two-position switch similar to manual switch 54, and it likewise switches the network between the constant power and constant intensity modes. When switch 54 is in the constant intensity mode, switch 62 is connected to line 52 and is able to connect that line to either terminal 68 or terminal 70. Terminal 68 is connected to the constant intensity network. Terminal 70, which is connected to constant power terminal 58, is the terminal which switch 62 normally contacts. Activation of switch 62 by relay element 64 therefore switches the apparatus from the constant power mode to the constant light intensity mode. Both automatic switch 62 and manual switch 54 must therefore be in their constant intensity positions for the apparatus to be in a constant intensity mode.

A light sensing circuit 72 is used to monitor the intensity of lamp 30 and to produce an output corresponding to that intensity along lines 74 and 76. Circuit 72 may include a pair of phototransistor light sensors 78 and 80 shown in FIG. 4 for monitoring light of different wavelengths. The phototransistors are provided with different interference filters to maximize either the 365 or 400 nanometer wavelengths currently specified for negative and positive photoresists, respectively. The phototransistors are connected to the remainder of circuit 72 by a plug and socket arrangement 82 carrying the emitter and collector of each. The emitters of the two phototransistors are shorted at junction 83, while the collector of phototransistor 78 is connected to a series resistor 84 and the collector of phototransistor 80 is connected in series to the series combination of resistors 86 and 88 in that order. The remote ends of resistors 84 and 88 are connected together and to a constant positive voltage source at terminal 90. Resistor 88 is variable to allow internal calibration of the light sensing circuit 72 to respond identically to light incident on the two phototransistors. Junction 83 is connected to the light detector 66 by the line 76. In the light detector, the line 76 is connected to ground through resistor 92 and to the input 94 of the amplifier formed by npn transistor 96 and pnp transistor 98. Input 94 is connected to the base terminal of transistor 96. The emitter of transistor 96 is grounded, while its collector is connected to the base of transistor 98 through resistor 100. The emitter of transistor 98 is connected to a positive 30 volts at terminal 102 while its collector is connected to ground through a series combination of resistor 104 and relay 64 in that order.

The phototransistor light sensors 78 and 80, in series with the resistor 84 and with the series combination of resistors 86 and 88, respectively, serve to vary the voltage applied at terminal 90 in accordance with the intensity of the incident light. A particular light intensity will lead to a corresponding voltage from collector to emitter ($V_{CE}$) of the particular phototransistor. Any change in light intensity will vary the resistance across the phototransistor, and therefore vary $V_{CE}$. A decrease in light intensity, such as that due to ordinary aging of the mercury arc lamp 30, causes $V_{CE}$ to increase.

The light detector 66 senses current flow through the phototransistors 78 and 80, and amplifies that current to actuate relay element 64. This causes switch 62 to move from its rest position contacting terminal 70 to its activated position contacting terminal 68, placing the apparatus in the constant intensity mode as long as the manual switch 54 is also in the constant intensity position. Since current flows through the phototransistors only when light is incident thereon, the apparatus is thus locked out of the constant intensity mode in the absence of incident light.

In the field of photolithography, a shutter of an associated photomachine is commonly used to control the exposure of a workpiece to lamp light. The construction and operation of such photomachines and their shutters are, of course, well-known in the photolithographic art. The switch 62 allows the apparatus of the present invention to be placed in the constant intensity mode only when the shutter of such a photomachine is open, in which condition light from the lamp 30 impinges on the phototransistors. Otherwise, the apparatus is held in the constant power mode wherein a constant level of power recommended by the lamp manufacturer is provided to the lamp 30. This is necessary because light sensing circuit 72 is inoperative to maintain the light intensity constant when no light is incident on phototransistors 78 and 80. If left in control of the power supply, the light sensing circuit 72 would cause the power supply to power lamp 30 at its maximum level.

Line 74 is connected to manual two-position switch 106 which is adapted to connect that line to the collector of either phototransistor 78 or phototransistor 80. The decision as to which is to be used depends upon the wavelength of the light to be monitored. Line 74 is connected to ground through a series combination of resistor 108, potentiometer 110 and resistor 112. The movable contact lead 114 of potentiometer 110 is connected through resistor 116 to the "−" input terminal 118 of a differential amplifier 120. An integrated circuit may be used as differential amplifier 120. A resistor 122 is then connected between input terminal 118 and output terminal 124 of that integrated circuit, while a capacitance 126 is connected across two other of its terminals 128 and 130. The "+" input terminal 132 is connected to ground through a resistor 134 and to the movable contact 136 of a potentiometer 138 through a resistor 140. One of the fixed resistance terminals 142 of potentiometer 138 is connected to ground while the other is connected to a constant positive twelve volts through resistor 144 and terminal 146.

A voltage corresponding to that across the phototransistor sensor selected by switch 106 is therefore applied to differential amplifier 120 to be compared with a reference voltage ($V_{REF}$) produced by potentiometer 138 and its surrounding circuitry. The differential amplifier output voltage is set to zero by potentiometer 138 when the apparatus is in the constant power mode. This calibrates the apparatus at an operating point of lamp intensity equal to the intensity of light produced by the lamp 30 at the predetermined constant power level supplied to it in the constant power mode. The calibration must be performed whenever the lamp is replaced or the optics of the lamphouse are changed, as when condenser lens settings are varied. The device may then be placed in the constant intensity mode and the lamp intensity adjusted to a desired level using the potentiometer 110.

Differential amplifier 120 may consist of integrated circuit LM308 which is connected to a predetermined positive and negative supply voltage at its pins 7 and 4, respectively. Input terminals 118 and 132 are the pins 2 and 3, respectively, while capacitance terminals 128 and 130 are pins 1 and 8. In this configuration, the differential amplifier 120 acts as both a voltage comparator and an inverter, producing a negative output voltage at the terminal 124 whenever the voltage applied to the terminal 118 is greater than $V_{REF}$ applied to the terminal 132.

A window comparator 148 and an LED 150 are connected to the output 124 of differential amplifier 120 for visual display of proper calibration of the apparatus of the present invention to the operating point of lamp intensity discussed above. The window comparator 148 includes amplifiers 152, 154 and 156. The "+" input terminal 158 of amplifier 152 and the "−" input terminal 160 of amplifier 154 are connected to output 124. The "−" terminal 162 of amplifier 152 is connected to a positive 12 volt DC source through series resistors 164 and 166 in that order, and to a negative 12 volt DC source through fixed resistor 168 and variable resistor 170. The "+" terminal 172 of amplifier 154 is connected between resistors 164 and 166. Capacitor 174 is connected between the inputs of amplifier 154 to eliminate amplifier oscillations. The outputs 176 and 178 of amplifiers 152 and 154, respectively, are shorted at junction 180. Junction 180 is connected to a positive 12 volt DC source at terminal 182 through a resistor 184 and to the "−" input terminal 186 of amplifier 156. The "+" input terminal 188 of amplifier 156 is connected to terminal 182 through resistor 190. Output 192 of amplifier 156 is connected to the cathode of LED 150 through resistor 194. The anode of LED 150 is connected to manual switch 54 for switching between an open circuit condition corresponding to the constant intensity position of switch 54 and a condition of connection to a terminal 196 corresponding to the constant power position of switch 54. LED 150 is therefore caused to ignite when the switch 54 is in the constant power position and the voltage at output 124 of differential amplifier 120 is made to fall within an extremely narrow range or "window" of values centered about zero volts.

Placing the apparatus in the constant power mode by moving the switch 54 supplies the lamp 30 with a predetermined constant level of power and operatively connects the LED 150 to the window comparator 148. The light sensing circuit 72 then causes a particular voltage to be applied to the terminal 118 of the differential amplifier 120. The potentiometer 138 can thereafter be adjusted to vary $V_{REF}$ at terminal 132 to ignite LED 150, at which point $V_{REF}$ is almost exactly equal to the voltage at terminal 118. The apparatus is then calibrated. Switching the apparatus to the constant intensity mode will then cause the voltage at terminal 118 due to operation of the light sensing circuit in that mode to be compared with a $V_{REF}$ equal to the corresponding voltage in the constant power mode.

Amplifiers 152, 154 and 156 may be included within a single integrated circuit such as the commercially available LM339. Positive and negative supply voltages are then applied to the pins designated by the manufacturer as 3 and 12, respectively. Terminals 158, 162, 172 and 160 correspond to pins 11, 10, 9 and 8 respectively of LM339. Terminals 176, 178, 188, 186 and 192 likewise correspond to pins 14, 13, 5, 4 and 2, respectively.

Auto gain circuit 198 causes the current $I_{control}$ to flow along line 200 toward terminal 68. It comprises an amplifier 202, diode 204, capacitor 206 and npn transistor 208. The "+" input terminal 210 of amplifier 202 is connected to output 124 of amplifier 120. The "−" input terminal 212 is grounded, and capacitor 214 is connected across terminals 216 and 218. Output terminal 220 of amplifier 202 is connected to the anode of diode 204. The cathode of diode 204 is connected to ground through a capacitor 206 and to the base of transistor 208 through resistor 222. The collector of transistor 208 is connected to line 200 and the emitter is grounded. Resistor 224 is connected between the emitter and collector. Amplifier 202 may be integrated circuit LM308, Terminals 210, 212, 220, 216 and 218 then become pins 3, 2, 6, 1 and 8, respectively, of the integrated circuit's package.

Auto gain circuit 198 therefore varies $I_{control}$ through transistor 208 in relation to the voltage input to terminal 210 from differential amplifier 120. When a positive output from differential amplifier 120 is caused by increased light on sensors 78 and 80, capacitor 206 will charge positive causing a larger current $I_{control}$ to develop through transistor 208. When switches 62 and 54 are in their constant intensity modes, $I_{control}$ therefore tells the power supply to increase or decrease its output power to lamp 30 according to the formula: $P_{out} \approx 1/I_{control}$. $P_{out}$ would thus decrease to adjust for a constant intensity. In actual practice, the output from differential amplifier 120 will turn negative as lamp intensity decreases due to aging of the lamp. $I_{control}$ will then become smaller, causing $P_{out}$ to increase to adjust for a constant intensity.

Day/night switch 226 designed to switch the system to a low power mode for the night or during other long periods of disuse, may be of the two-position "on-off" type. It is adapted to ground terminal 56 in its closed circuit position, increasing $I_{control}$ to its maximum. $P_{out}$ to the lamp is thus decreased to a minimum operating value, reducing the rate at which mercury and electrode material is deposited on the interior surface of the glass and thereby increasing the lamp's usable life. This is particularly advantageous because DC mercury arc lamps are designed to burn constantly once ignited, but they deteriorate much more rapidly at higher power levels.

Maximum wattage indicator circuit 228 indicates when the output to the lamp from the power supply reaches a preset maximum. That maximum is the highest operating power level recommended by the lamp manufacturer. Indicator circuit 228 includes an amplifier 230 and a LED 232. The + input terminal 234 of amplifier 230 is connected to the base of transistor 208 through resistor 236. The − terminal 240 of amplifier 230 is connected both to the movable contact of potentiometer 238 and to ground through resistor 242. The fixed resistance of the potentiometer 238 is connected between ground and a positive twelve volt source. Resistor 246 is connected between + terminal 234 and output terminal 244 of amplifier 230. Terminal 248 is connected to output terminal 244 by a resistor 250. Switch 252 is an automatically actuated switch controlled by relay element 64 between a normal "constant power" open circuit condition and an activated closed circuit "contant intensity" condition. It is adapted to close the circuit in its activated state between terminal 248 and the cathode of LED 232. The anode of LED 232 is connected to a positive 15 volt DC source at terminal 254.

Amplifier 230 may be a part of the same integrated circuit LM339 which may be used for the amplifiers 152, 154 and 156 of window comparator 148. In that case, terminals 234, 240 and 244 correspond to pins 7, 6 and 1, respectively.

As the voltage from base to emitter of transistor 208 decreases, $P_{out}$ to the lamp increases. The maximum wattage indicator circuit 228 detects the maximum wattage by comparison of the voltage from the movable contact of potentiometer 238 to ground ($\equiv V_{238}$) with the voltage from base to emitter of transistor 208 ($\equiv V_{BE208}$). As long as $V_{BE208}$ is greater than $V_{238}$, differential amplifier 230 has a high positive output which is applied to the cathode of LED 232 to prevent its ignition. When $V_{BE208}$ falls to the point where it is equal to $V_{238}$, the output of differential amplifier 230 falls to zero and the positive potential at terminal 254 is able to ignite the LED. The circuit parameters are preferably chosen such that LED 232 ignites in this way when $I_{control}$ decreases to a value equal to the minimum current $I_{MIN}$ programmed into the current limiter 48 of FIG. 1. Ignition of LED 232 thus signifies that the lamp 30 is receiving the highest level of power that the power apparatus of FIG. 1 will ever apply to it, and therefore that the lamp 30 must be replaced if constant light intensity is to be maintained.

Power is provided to various points of the interface by zener diode regulated power supply 256. It may include a 117 volt to 24 volt center tapped transformer 258 whose primary leads 260 are connected to a source of line voltage and secondary leads 262 are connected to the input terminals of a full wave bridge rectifier 264. The positive output terminal of rectifier 264 is connected to ground through the parallel combination of a filter capacitor 266 and the series combination of resistor 268 and zener diode 270. The zener diode is positioned between ground and resistor 268, with its anode to ground. The negative output terminal of rectifier 264 is connected to ground by a similar parallel combination of a filter capacitor 272 with the series combination of resistor 274 with zener diode 276. The zene diode 276 is positioned between ground and resistor 274, with its cathode to ground. Terminal 278 is connected directly to the positive terminal of rectifier 264. Terminal 280 is connected to the junction between resistor 268 and zener diode 270, while terminal 282 is connected to the junction between resistor 274 and zener diode 276. The circuit parameters may be chosen to provide an unregulated positive 15 volt DC output at terminal 278 and regulated positive and negative 12 volt DC outputs at terminals 280 and 282, respectively.

Figure 3:
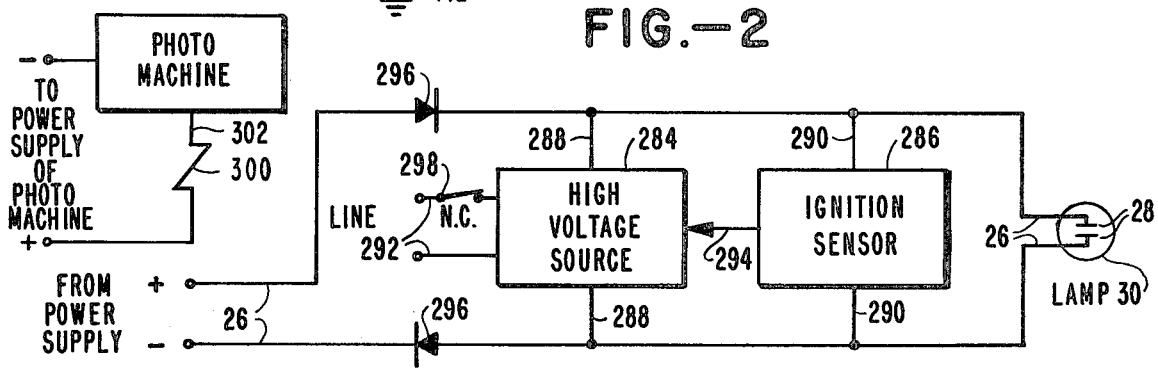
FIG. 3 is a block diagram of a mercury arc lamp igniter constructed in accordance with the invention.

The igniter circuitry of FIG. 3 applies an automatic single high voltage pulse across the lamp electrodes. It includes a high voltage source 284 and an ignition sensor 286. Output leads 288 of source 284 are connected in parallel with input leads 290 of sensor 286 across the leads 26 of lamp 30. High voltage source 284 is connected to line voltage by lines 292. When activated, high voltage source 284 applies a series of high voltage pulses spaced apart in time until ignition occurs. When ignition occurs, the steady voltage applied across leads 26 to power lamp 30 will be reduced from its initial value of approximately 140 volts to less than 100 volts. Ignition sensor 286 senses that voltage drop and sends a signal along line 294 to tell source 284 to cease sending pulses to the lamp. In this way, a minimum number of pulses are used to ignite lamp 30. Because the pulses are often in the neighborhood of 25,000 volts, this can save considerable wear on the lamp.

Diodes 296 allow current flow in lines 26 only according to the polarity of the lamp operating power.

The particular high voltage source 284 and ignition sensor 286 are commercially available at this time as a unit from Electronic Measurements, Inc. of Neptune, N.J. The commercially available unit is known as Pos. Igniter EMHG 200.

Normally closed relay switch 298 is operatively connected to a relay element 300 in the power circuit 302 of the accompanying photomachine. When the photomachine is in operation, relay switch 298 is opened, preventing high voltage ignition pulses from being applied to the lamp. This avoids damage to the sensitive photomachine from the high magnetic and electric fields which accompany those pulses.

FIG. 2 is a somewhat simplified block diagram of the constant light intensity interface of FIG. 4, in which R1 is the network of resistors 108, 112 and 116 in combination with the potentiometer 110, and R2 is the network of resistors 140, 134 and 144 in combination with the potentiometer 138. R3 is the potentiometer 61 of FIG. 4. For the sake of simplicity, the resistors 122 and the capacitor 126 connected to the differential amplifier 120 of FIG. 4 are internalized to form the corresponding differential amplifier 120′ of FIG. 2. In similar fashion, the switch 62 which is automatically actuable by the relay element 64 has been included within the auto gain circuit 198′ corresponding to the circuit 198 of FIG. 4. The lines through which the switch 62 can be placed in connection with the terminal 58 are omitted. The LED 150 is illustrated diagrammatically extending from the window comparator 148, and the single line 73 leading from the light sensing circuit 72 diagrammatically represents two separate electrical conductors connected to the lines 74 and 76, respectively.

Referring now to FIGS. 1 and 2, it can be seen that in the constant intensity mode, for which the switch 54 contacts the terminal 56, the interface of FIG. 2 controls the output of the power supply of FIG. 1 to the lamp 30 by varying $I_{control}$ to compensate for changes in the intensity of light incident on the sensors. This is done by comparing the voltage across the sensors when the light from lamp 30 is incident thereon with a reference voltage ($V_{REF}$), and causing $I_{control}$ to decrease as the light intensity decreases from aging of the lamp 30. This increases $P_{out}$ to the lamp to bring the intensity back to the level held initially.

$V_{REF}$ is the voltage across the resistive network R2, and is therefore variable through potentiometer 138 of FIG. 4. The voltage across the light sensing circuit, as conditioned by the variable network R1, is applied to the "−" input terminal of the differential amplifier 120′ as a sensor feedback voltage while $V_{REF}$ is applied to the "+" terminal thereof. The output at terminal 124 is therefore the negative of the difference between the sensor feedback voltage and $V_{REF}$.

When the sensor feedback voltage equals $V_{REF}$ in the constant intensity mode, the output of the differential amplifier 120′ at terminal 124 goes to zero. A zero voltage input to the auto gain circuit 198′ causes a constant current $I_{control}$ to pass to the current limiter 48 of FIG. 1, resulting in a constant current equal to $1/I_{control}$ in the line 46 and a constant power level to the lamp 30.

A decrease in the intensity of light incident on the sensors causes the sensor feedback voltage to increase, resulting in a negative voltage at terminal 124. This negative voltage, in turn, causes the auto gain circuit 198' to step down $I_{control}$ an appropriate amount. Assuming this new value of $I_{control}$ is between the limits $I_{MIN}$ and $I_{MAX}$ preset into the current limiter 48, the current $1/I_{control}$ is greater than before, causing the output of the comparator 42 to increase and thereby increase power to the lamp. When the intensity of light incident on the sensors reaches the level originally held, the senor feedback voltage once again requals $V_{REF}$. The output of the differential amplifier 120' then falls to zero, holding $P_{OUT}$ to the lamp constant.

The apparatus is manually placed in the constant power mode as discussed hereinabove, by moving switch 54 to contact terminal 58. A predetermined constant control current then flows in line 52 to the power supply of FIG. 1, causing a constant level of electrical power to be applied to the lamp 30.

When the lamp 30 is replaced or the characteristics of the optical path between the lamp 30 and the sensors are altered, the relationship between the sensor feedback voltage and $V_{REF}$ is disrupted. In order to bring the apparatus back to a satisfactory operating point, $V_{REF}$ is adjusted to just equal the sensor feedback voltage when light of the desired intensity is incident on the sensors. This is easily accomplished in the instant invention with the window comparator 148. Switch 54 is moved to connect the line 52 to the terminal 58 and to connect the terminal 196 to the LED 150, placing the apparatus in the constant power mode and at the same time switching on the window comparator 148. In this condition, a sensor feedback voltage corresponding to the intensity of light developed at the sensors from application of said predetermined constant power level to the lamp 30 is compared with $V_{REF}$ by the differential amplifier 120'. $V_{REF}$ can then be adjusted by manually varying the setting of the potentiometer 138 within the resistive network R2 until the LED 150 ignites, signalling that the output of the differential amplifier 120' is within a very narrow range about the value of zero volts and thus that $V_{REF}$ is substantially equal to the sensor feedback voltage. On switching the apparatus back to the constant intensity mode, the power to the lamp 30 is therefore automatically controlled such that the sensor feedback voltage equals the new value of $V_{REF}$. This results in a constant light intensity at the sensors equal to the intensity of light produced in the constant power mode at the time $V_{REF}$ was adjusted. The level of light intensity in the constant intensity mode can then be further adjusted, if desired, by manually varying the setting of the potentiometer 110 within the resistive network R1. Adjustment of the potentiometer relative to the reading of an external light meter positioned to independently read the light intensity at the sensors enables the constant intensity level to be adjusted to a predetermined absolute value.

As discussed above in relation to FIG. 4, the relay element 64 of the light detector 66 operates wherever light from the lamp 30 is incident on the phototransistor light sensors 78 and 80 to actuate the automatic switch element 62 from its normal condition contacting the terminal 70 to its activated condition contacting the terminal 68. The location of the switch 62 between the transistor 208 and the terminal 56 of the switch 54 results in the apparatus being locked out of the constant intensity mode unless light from the lamp 30 is incident on the senors. This prevents the constant intensity interface of FIG. 2 from automatically increasing power to lamp 30 to its maximum level whenever the path of light from lamp 30 to the sensors 78 and 80 is interrupted, as by a shutter of the type ordinarily used in photolithographic exposure machines. The apparatus is held in the constant power mode during this period at the optimum power level recommended by the manufacturer, preventing unnecessary aging of the lamp 30.

When the lamp 30 deteriorates to the point at which the power apparatus in the constant intensity mode provides the lamp 30 with a level of power equal to the maximum level that the manufacturer states can safely be applied to it, the LED 232 of the maximum wattage indicator circuit 228 ignites. This maximum power level coincides with the minimum limit built into the current limiter 48 for the control current $I_{control}$, and therefore with the maximum power level which the power supply of FIG. 1 will supply to the lamp 30. The apparatus therefore ceases to operate as a constant intensity source at that point.

The "DAY/NIGHT" switch 226 of FIGS. 2 and 4 serves to ground the circuit carrying $I_{control}$, increasing $I_{control}$ to a maximum level and thereby reducing the power to the lamp to its minimum value. The switch 226 may be closed at night and during other relatively long periods of disuse to minimize wear on the lamp.

Referring now to FIG. 3, the lamp 30 can be ignited by the high voltage source 284 only when the power to the accompanying photomachine is cut off. The relay element 300 is then de-energized, leaving the relay switch 298 in its normally closed condition to connect the high voltage source 284 to line voltage through the lines 292. Otherwise, the relay switch 298 is held open to prevent damage to the sensitive photomachine from the high electric and magnetic fields produced during lamp ignition.

Having fully described the invention, it is intended that it be limited only by the lawful scope of the appended claims.

I claim:

1. A power apparatus for driving a lamp at constant light intensity in photolithographic processes, including:

an optical sensor circuit wherein a phototransistor indicates the intensity of light of a desired wavelength range incident on a surface by varying an applied voltage to yield a sensor feedback voltage corresponding to that intensity, said phototransistor positioned directly in the path of said light for exposure to the full intensity thereof;

a switching direct current power supply capable of producing a regulated variable power output to said lamp in response to an electrical control input;

a feedback interface circuit between said optical sensor circuit and said power supply providing said electrical control input to said power supply in response to said sensor feedback voltage to maintain the intensity of said light incident on said surface at a constant level, said interface circuit including means for automatically comparing said sensor feedback voltage to a reference voltage and varying said electrical control input and thus the power supply output to said lamp to eliminate any difference in those voltages, and internal calibration means for recalibrating said apparatus after the optical characteristics of said lamp have been altered, said calibration means comprising:

means for applying to said power supply a predetermined electrical control input causing said power supply to drive said lamp at a predetermined electrical power level;

means for manually adjusting said reference voltage relative to said sensor feedback voltage resulting from said predetermined electrical power level; and means for automatically indicating when said reference voltage substantially equals the sensor feedback voltage resulting from said predetermined electrical power level comprising a light emitting diode and a window comparator circuit automatically analyzing the output of said automatic comparison means of said interface circuit and igniting said light emitting diode when said output of said automatic comparison means becomes substantially zero, indicating that said reference voltage substantially equals said sensor feedback voltage;

whereby said power apparatus can be readily calibrated to operate at a constant intensity of lamp light incident on said surface by manually adjusting said reference voltage to substantially equal said sensor feedback voltage resulting from said predetermined electrical power level, said constant intensity having a value substantially equal to the intensity produced on said surface at said predetermined electrical power level.

2. A power apparatus for driving a lamp at constant light intensity in photolithographic processes in conjunction with a highly sensitive photomachine having its own power supply, including:

an optical sensor circuit wherein a phototransistor indicates the intensity of light of a desired wavelength range incident on a surface by varying an applied voltage to yield a senor feedback voltage corresponding to that intensity, said phototransistor positioned directly in the path of said light for exposure to the full intensity thereof;

a switching direct current power supply capable of producing a regulated variable power output to said lamp in response to an electrical control input;

a feedback interface circuit between said optical sensor circuit and said power supply providing said electrical control input to said power supply in response to said sensor feedback voltage to maintain the intensity of said light incident on said surface at a constant level, said interface circuit including means for automatically comparing said sensor feedback voltage to a reference voltage and varying said electrical control input and thus the power supply output to said lamp to eliminate any difference in those voltages, and internal calibration means for recalibrating said apparatus after the optical characteristics of said lamp have been altered, said calibration means comprising:

means for applying to said power supply a predetermined electrical control input causing said power supply to drive said lamp at a predetermined electrical power level;

means for manually adjusting said reference voltage relative to said sensor feedback voltage resulting from said predetermined electrical power level; and means for automatically indicating when said reference voltage substantially equals the sensor feedback voltage resulting from said predetermined electrical power level;

whereby said power apparatus can be readily calibrated to operate at a constant intensity of lamp light incident on said surface by manually adjusting said reference voltage to substantially equal said sensor feedback voltage resulting from said predetermined electrical power level, said constant intensity having a value substantially equal to the intensity produced on said surface at said predetermined electrical power level;

a lamp ignition device comprising:

means for applying a series of single high voltage electrical pulses of similar polarity spaced apart in time to the electrodes of the lamp as said regulated power supply output is applied thereto; and means for automatically terminating said series of pulses when the lamp ignites, comprising means connected in parallel with said electrodes for directly sensing a predetermined voltage drop associated with ignition across said electrodes and for automatically preventing said pulse application means from further pulsing the lamp after said predetermined voltage drop occurs; and protective relay means sensing current flow in the power supply circuit of the photomachine and automatically disabling said ignition device when said current flow is present.

3. A power apparatus for driving a mercury vapor lamp at constant light intensity in photolithographic processes in conjunction with a highly sensitive photomachine having its own power supply, including:

an optical sensor circuit wherein a phototransistor indicates the intensity of light of a desired wavelength range incident on a surface by varying an applied voltage to yield a sensor feedback voltage corresponding to that intensity, said phototransistor positioned directly in the path of said light for exposure to the full intensity thereof;

a switching direct current power supply capable of producing a regulated variable power output to said lamp in response to an electrical control input, including a first isolating transformer at the line input to said power supply, a second isolating transformer at the output of said power supply, and a power supply feedback circuit automatically comparing the output current of said power supply with said electrical control input and varying said electrical control input to minimize line fluctuations and noise in the power applied to the lamp;

a feedback interface circuit between said optical sensor circuit and said power supply providing said electrical control input to said power supply in response to said sensor feedback voltage to maintain the intensity of said light incident on said surface at a constant level, said interface circuit including means for automatically comparing said sensor feedback voltage to a reference voltage and varying said electrical control input and thus the power supply output to said lamp to eliminate any difference in those voltages; and internal calibration means for recalibrating said apparatus after the optical characteristics of said lamp have been altered, said calibration means comprising:

means for applying to said power supply a predetermined electrical control input causing said power supply to drive said lamp at a predetermined electrical power level;

means for manually adjusting said reference voltage relative to said sensor feedback voltage resulting from said predetermined electrical power level; and means for automatically indicating when said reference voltage substantially equals the sensor feedback voltage resulting from said predetermined electrical power level;

whereby said power apparatus can be readily calibrated to operate at a constant intensity of lamp light incident on said surface by manually adjusting said reference voltage to substantially equal said sensor feedback voltage resulting from said predetermined electrical power level, said constant intensity having a value within a relatively narrow range and substantially equal to the intensity produced at said predetermined electrical power level;

a lamp ignition device comprising:

means for applying a series of single high voltage electrical pulses of similar polarity spaced apart in time to the electrodes of the lamp as said regulated power supply output is applied thereto;

means for automatically terminating said series of pulses when the lamp ignites, comprising means connected in parallel with said electrodes for directly sensing a predetermined voltage drop associated with ignition across said electrodes and for automatically preventing said pulse application means from further pulsing the lamp after said predetermined voltage drop occurs; and protective relay means sensing current flow in the power supply circuit of the photomachine and automatically disabling said ignition device when said current flow is present.

* * * * *